US006065864A

United States Patent [19]

Evans et al.

[11] Patent Number: 6,065,864

[45] Date of Patent: May 23, 2000

[54] APPARATUS AND METHOD FOR PLANAR LAMINAR MIXING

[75] Inventors: John Evans, El Cerrito; Dorian Liepmann, Lafayette; Albert P. Pisano, Livermore, all of Calif.

[73] Assignee: The Regents of the University of California, Oakland, Calif.

[21] Appl. No.: 08/999,597

[22] Filed: Jan. 23, 1998

Related U.S. Application Data

[60] Provisional application No. 60/036,732, Jan. 24, 1997.

[51] Int. Cl.[7] ..... B01F 5/04; B01F 15/02

[52] U.S. Cl. ..... 366/167.1; 366/349; 366/182.2; 366/182.4; 417/208; 251/369

[58] Field of Search ..... 366/173.1, 167.1, 366/182.1, 182.2, 182.3, 182.4, 131, 136, 159.1, 176.3, 267, 268, 269, 349; 417/208, 207, 51, 48; 251/11, 369; 216/2; 137/820, 827

[56] References Cited

U.S. PATENT DOCUMENTS

| | | | |
|---|---|---|---|
| 3,893,766 | 7/1975 | Hogg | 356/36 |
| 4,792,283 | 12/1988 | Okayasu | 417/52 |
| 5,304,487 | 4/1994 | Wilding et al. | 435/291 |
| 5,375,979 | 12/1994 | Trah | 417/52 |
| 5,479,196 | 12/1995 | Inada | 347/92 |
| 5,597,236 | 1/1997 | Fasano | 366/181.5 |
| 5,637,469 | 6/1997 | Wilding et al. | 435/7.21 |
| 5,726,404 | 3/1998 | Brody | 200/81 R |
| 5,850,241 | 12/1998 | Silverbrook | 347/54 |

FOREIGN PATENT DOCUMENTS

| | | | |
|---|---|---|---|
| 777 261 | 11/1980 | U.S.S.R. | 417/52 |

*Primary Examiner*—Tony G. Soohoo
*Attorney, Agent, or Firm*—William S. Galliani; Pennie & Edmonds LLP

[57] ABSTRACT

A microelectromechanical system mixes a fluid using predominantly planar laminar flow. The microelectromechanical system includes a mixing chamber and a set of valves to establish the planar laminar flow in the mixing chamber. In one embodiment, bubble-controlled pumps are operated with bubble-controlled valves to establish the predominantly planar laminar flow in the mixing chamber. The bubble-controlled pumps and valves may be used to establish a pulsed double-dipole flow field in the mixing chamber.

19 Claims, 16 Drawing Sheets

APPARATUS AND METHOD FOR PLANAR LAMINAR MIXING

This application claims priority to the provisional patent application entitled "Apparatus and Method for Planar Laminar Mixing", filed Jan. 24, 1997, Serial No. 60/036,732.

BRIEF DESCRIPTION OF THE INVENTION

This invention relates generally to microelectromechanical systems (MEMS). More particularly, this invention relates to the use of MEMS for mixing one or more fluids.

BACKGROUND OF THE INVENTION

Microelectromechanical systems (MEMS), which are sometimes called micromechanical devices or micromachines, are three dimensional objects having one or more dimensions ranging from microns to millimeters in size. The devices are generally fabricated utilizing semiconductor processing techniques, such as lithographic technologies.

The use of MEMS to mix one or more fluids has numerous applications in industries ranging from chemical analysis, to printing, to medicine. As used herein, the term mix refers to combining two fluids, increasing the uniformity of a single fluid, decreasing the spacial or temporal gradients with respect to one or more fluid properties, or increasing small scale decomposed structure from large scale homogenous structure in a fluid.

As previously indicated, there are numerous applications for fluid mixing MEMS. For example, a device capable of mixing, and thereby processing, tens to hundreds of nanoliters of fluid would increase by two orders of magnitude the number of chemical tests that can be performed on a given volume of fluid. In printing, fluid-handling MEMS would allow for the mixing of inks "off-paper", thereby allowing for on-demand ink formation, increasing the print quality and decreasing the amount of ink required. In medicine, fluid-handling MEMS could be implanted under the skin, or incorporated in microfabricated needles, and programmed to mix and dispense assays according to current need or a pre-programmed schedule. Numerous additional applications exist for fluid-handling MEMS.

The ability to mix fluids thoroughly and in a reasonable amount of time is fundamental to the creation of fully integrated, "on-chip" MEMS fluid processing systems. Effective mixing of fluids requires that the fluids be manipulated or directed so that the contact area between the fluids is increased. In macroscopic devices this is generally done using turbulence, three-dimensional flow structures, or mechanical actuators. Since MEMS are fabricated in a planar, lithographic environment, design constraints mitigate against mechanical actuators. Further, the planar nature of MEMS prevents three-dimensional flow structures. That is, MEMS are essentially planar devices, including the X and Y axes defining the plane of the device. The design of structures in the third-dimensional Z axis (or vertical axis rising from the plane defined by the X and Y axes) is constrained by lithographic techniques. For example, lithographic techniques limit the Z axis structures to uniform shape and depth throughout the device. As a result, the Z axis dependence of the flow field will be uniform (e.g., parabolic) throughout the planar device. A flow with uniform Z dependence is referred to as planar flow. It is difficult to achieve mixing in this context.

The size and proportions of MEMS generally preclude relying on either turbulence or diffusion alone as mixing mechanisms. The size of fluid chambers in a MEMS can range from the picoliter, $(10\ \mu m)^3$, to the microliter, $mm^3$, range. Though fabrication constraints allow for picoliter chambers, few commonly used fluids are concentrated enough to be useful in such quantities. An upper bound on volumes of about 50 $\mu l$ is set by the size of a typical device (10 mm×10 mm×500 $\mu m$). Process volumes in the 100 nanoliter range allow multiple chambers to be fabricated on one die, yet provide sufficient fluid for many applications.

Turbulence occurs in flows characterized by high Reynolds numbers, defined as $$Re=(U\delta)/v, \quad [1]$$

where U is a characteristic velocity, δ is a length scale, and v is the kinematic viscosity (1 $mm^2/s$ for water). The appropriate length scale, typically the channel height, will in general be smaller than 500 $\mu m$. Assuming the highest velocity to be experienced for on-chip flows is one die length per second (U=10 mm/s), an upper bound on the Reynolds number is Re=5, with typical values being much lower. As turbulence in channel flow occurs only for Re>2000, on-chip flows are expected to be laminar, and thus turbulence is not available as a mixing mechanism. Moreover, flows with Re<<1, known as creeping flows, are symmetric and reversible. In this regime, a flow moving past an object will reconstitute itself, passing by the object unchanged, and "mixing" caused by a given set of manipulations to the fluid can be undone simply be reversing the set of manipulations. This precludes the use of barrier-fields, complex geometries, and severely limits the usefulness of mechanical actuators.

Similarly, the size and shape of MEMS limit the usefulness of diffusion as a sole mechanism for mixing. As it is difficult to place two fluids on top of each other in a planar MEMS, the length over which diffusion must act will be the in-plane dimension of the fluid chamber. Using Fick's equation, a diffusion mixing time scale, $T_D$ can be formed $$T_D=L^2/k, \quad [2]$$

where L is the relevant mixing length, and k is the Fickian diffusion constant ($k=10^3\ \mu m^2/s$ for salt in water, for example). Using L=1 mm, $T_D=10^3$ seconds=16.6 minutes. Even for L=100 $\mu m$, $T_D$=10 seconds. Such mixing times are generally too slow to rely on diffusion for effective mixing.

It would be highly desirable to overcome the foregoing difficulties associated with mixing fluids in a MEMS, and thereby provide a MEMS with improved mixing capacity.

SUMMARY OF THE INVENTION

A microelectromechanical system mixes a fluid using predominantly planar laminar flow. The microelectromechanical system includes a mixing chamber and a set of valves to establish the planar laminar flow in the mixing chamber. In one embodiment, bubble-controlled pumps are operated with bubble-controlled valves to establish the predominantly planar laminar flow in the mixing chamber. The bubble-controlled pumps and valves may be used to establish a pulsed double-dipole flow field in the mixing chamber. The bubble-controlled valves and pumps eliminate the need for moving parts. Therefore, the device results in high processing yields and long-term reliability.

BRIEF DESCRIPTION OF THE DRAWINGS

For a better understanding of the nature and objects of the invention, reference should be made to the following detailed description taken in conjunction with the accompanying drawings, in which.

Like reference numerals refer to corresponding parts throughout the several views of the drawings.

DETAILED DESCRIPTION OF THE INVENTION

Figure 1:
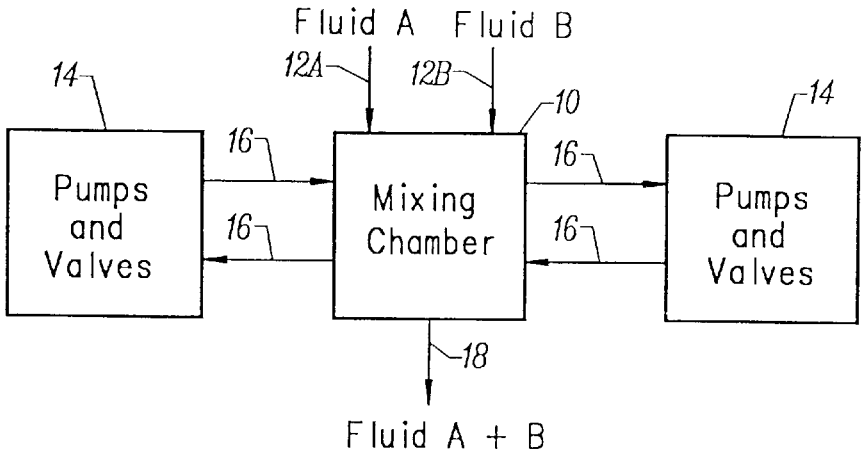
FIG. 1 is a generalized schematic illustrating the operation of the present invention.

The general concept of the invention is described in reference to FIG. 1. Fluids to be mixed are loaded into a mixing chamber 10 through one or more loading ports 12. Combinations of pumps and valves 14 operate to extract and inject quantities of fluid from the mixing chamber 10 through one or more fluid exchange ports 16, thereby creating a planar laminar flow field within the mixing chamber 10 to establish mixing. When sufficiently mixed, fluid is unloaded from the chamber through one or more unloading ports 18. The device of the invention may be operated in either batch or continuous mode.

Figure 2:
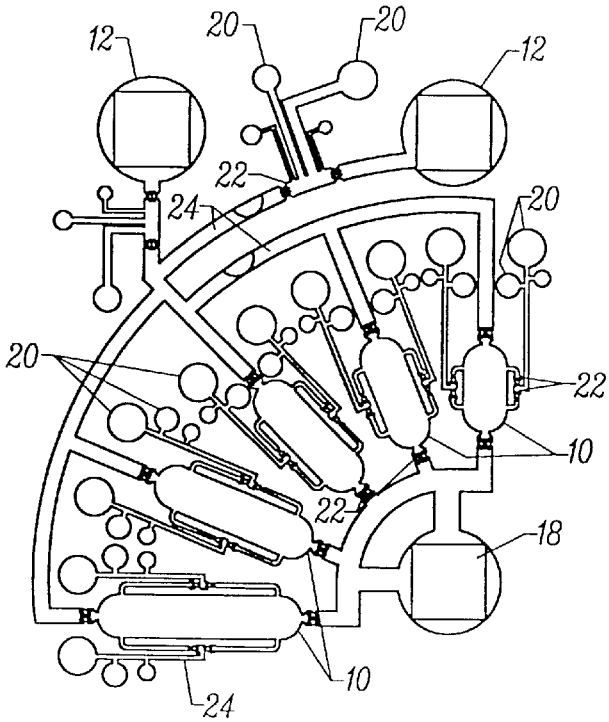
FIG. 2 is a schematic of an embodiment of multiple mixing chambers and related MEMS "plumbing" features constructed in accordance with an embodiment of the invention.

A die layout for an embodiment of the invention is shown in FIG. 2. The embodiment of FIG. 2 incorporates five mixing chambers 10 of varying aspect ratios, thirty-seven bubble pumps 20, forty-eight bubble-controlled valves 22, two loading ports 12, one unloading port 18, and ducts 24 of various dimensions on a 10 mm die. The planar nature of all components, made possible by the use of bubble valves and pumps, allows for easy batch fabrication of fully integrated systems such as the die shown.

Figure 3:
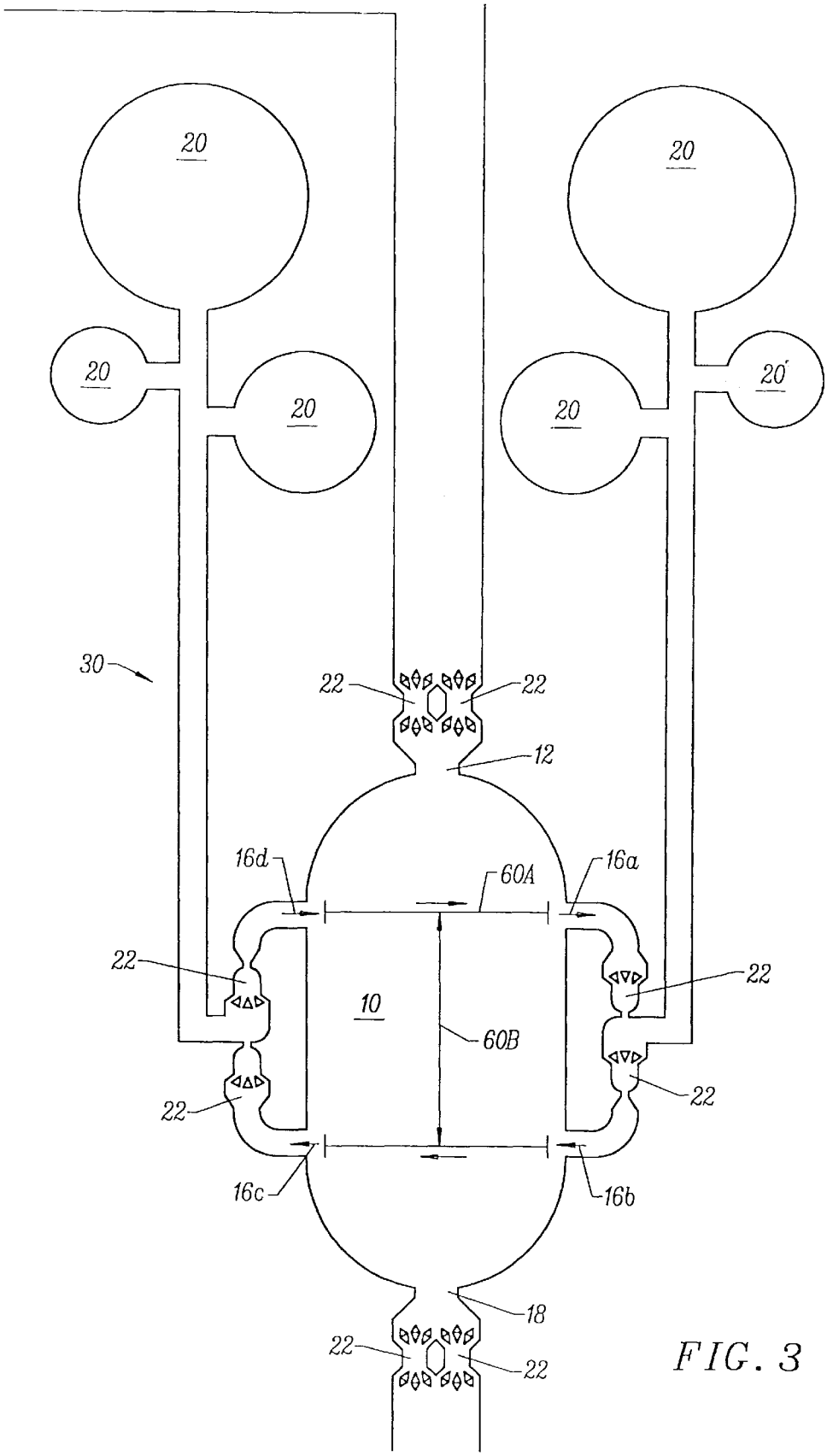
FIG. 3 illustrates a single mixing chamber in accordance with an embodiment of the invention.

A layout for an individual mixer 30 is shown in FIG. 3. The mixer 30 includes a mixing chamber 10. A loading port 12 and unloading port 18 are placed opposite each other. Various bubble-controlled valves 22 are used to load fluid from the bubble-controlled pumps 20 into the mixing chamber 10, and then prevent fluid from entering or leaving the chamber 10 while mixing is in progress. Fluid exchange ports 16 are placed at the corners of the rectangular portion of the mixing chamber 10, and in concert with the bubble-controlled valves 22 and bubble-controlled pumps 10, serve to create a pulsed double-dipole flow within the mixing chamber 10.

Figure 4:
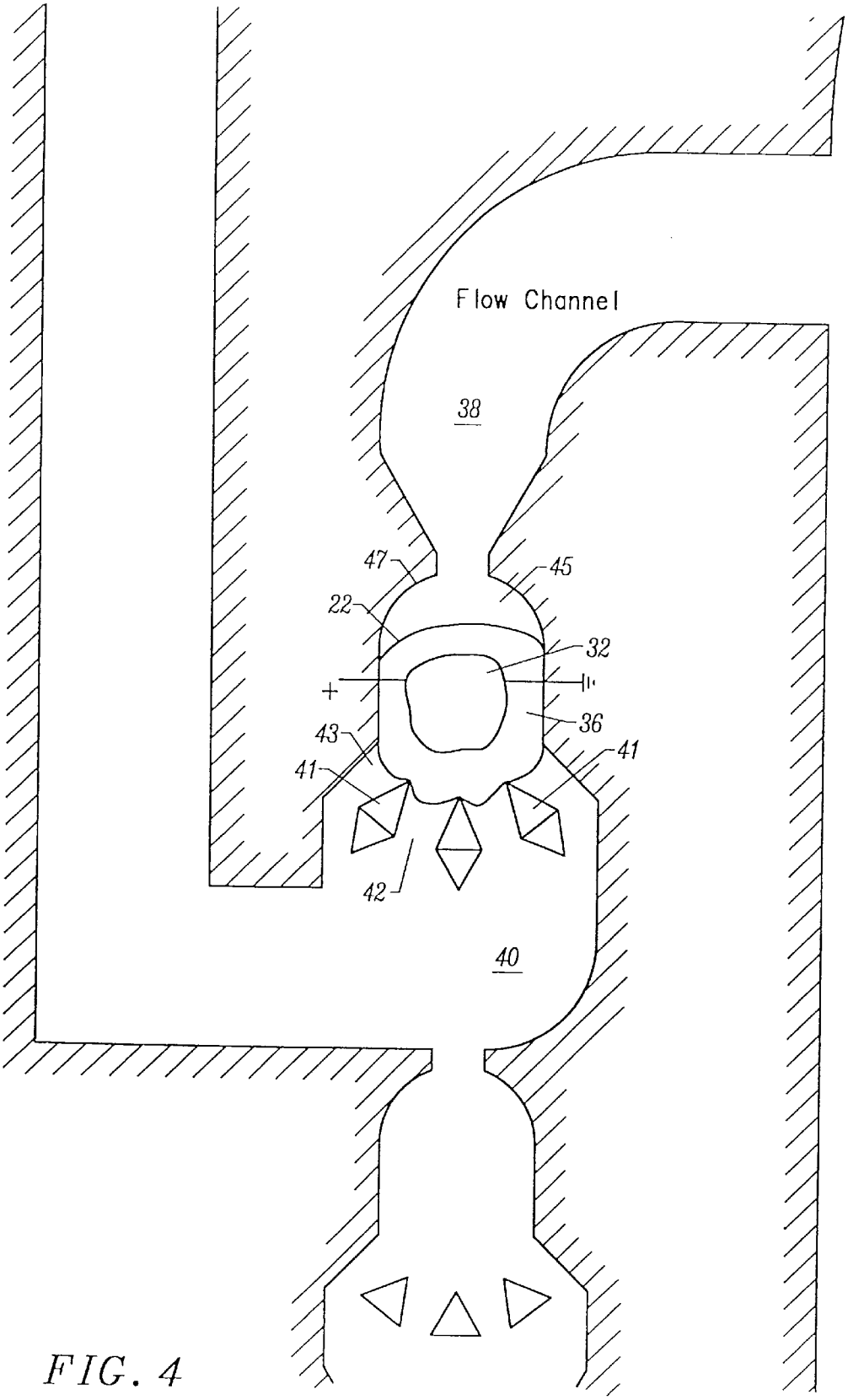
FIG. 4 illustrates the use of a bubble as a valve, in accordance with an embodiment of the invention.

FIG. 4 is an enlarged view of a single bubble-controlled valve 22 in accordance with an embodiment of the invention. The value 22 includes a heating element 32 placed on a surface (e.g., a cover plate, as described below) associated with the valve 22. When the heating element 32 is activated, fluid evaporates from the heating element surface to form a vapor bubble 36 in the fluid. The vapor condenses as it moves away from the heating element. If the evaporation rate exceeds the condensation rate, then the vapor bubble will grow. Conversely, if the condensation rate exceeds the evaporation rate, the bubble will shrink.

Preferably, a bubble shaping structure is used to improve the performance of the bubble-controlled valves 22. The bubble shaping structure is used to exploit the fact that a naturally formed bubble attempts to maintain a constant radius of curvature across its entire surface. Thus, for example, a bubble pushed into a converging passage, will attempt to maintain a constant radius of curvature, and will therefore resist the force pushing it into the converging passage.

Two independent bubble shaping techniques are used in the apparatus of FIG. 4. Diamond shaped columns 41 create multiple converging passages. As a result, the bubble interface 43 is divided, thereby decreasing its radius of curvature and increasing the pressure drop across the interface. The multiple converging passages still permit a reasonable flow area, in contrast to a geometry with a single small converging passage, that would provide the pressure differential, but not a sufficient flow area. The second bubble shaping technique is to have a bubble curvature increasing geometry, exemplified here as a circular geometry 47. The circular shape in this example at the upstream passage, increases the radius of curvature, decreasing the pressure drop across the interface 45. These techniques increase the net pressure drop sustainable by the bubble between regions 38 and 40.

Figure 5:
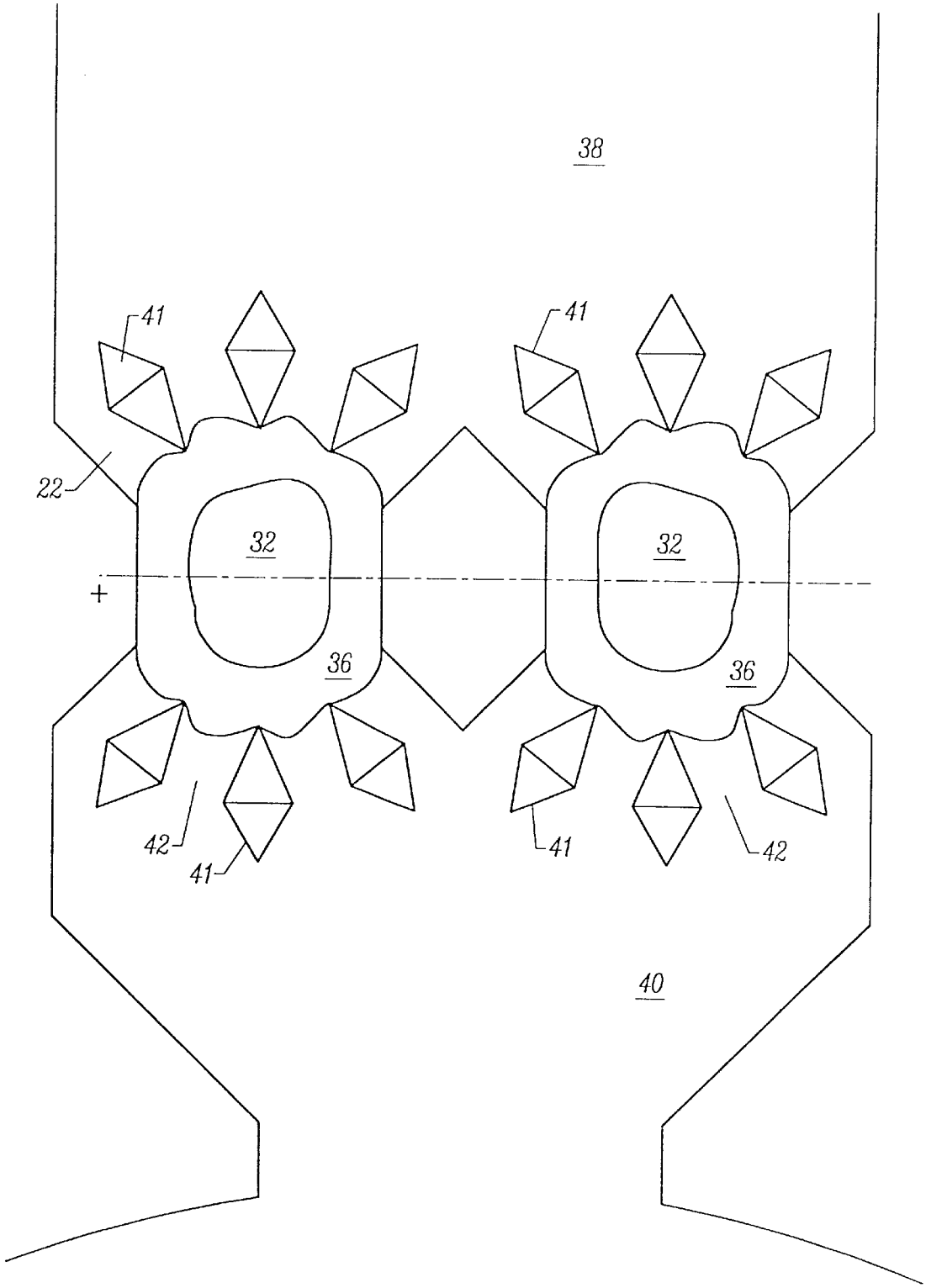
FIG. 5 illustrates a bi-directional valve in accordance with an embodiment of the invention.

Referring to FIG. 5, when the pressure in upstream region 38 exceeds that of downstream region 40, the bubble 36 moves against bubble shaping structures in the form of diamond shaped columns 41. These columns 41 are designed so that as the bubble 36 is forced towards region 40, the width of the channels 42 between the columns 41 decreases, thereby decreasing the radius of curvature of the bubble interface. This decrease in curvature increases the pressure drop across the interface, balancing the pressure difference between regions 38 and 40, thereby preventing flow. When the pressure in the downstream region 40 exceeds that of the upstream region 38, the bubble 36 is moved off of the columns 41, allowing flow toward the upstream region 38.

FIG. 5 demonstrates the layout for two bi-directional valves. In this embodiment, the columns 41 are placed at both ends of the valve 22. Activation of the heating elements 32 causes bubbles 36 to form, thereby closing the valve 22. A pressure differential between regions 38 and 40 causes the bubbles to become lodged on one of the two sets of columns 41, preventing flow in either direction. FIG. 5 illustrates the bubble 36 resting against both sets of columns for the purpose of demonstrating the bi-directional nature of the device.

Figure 6:
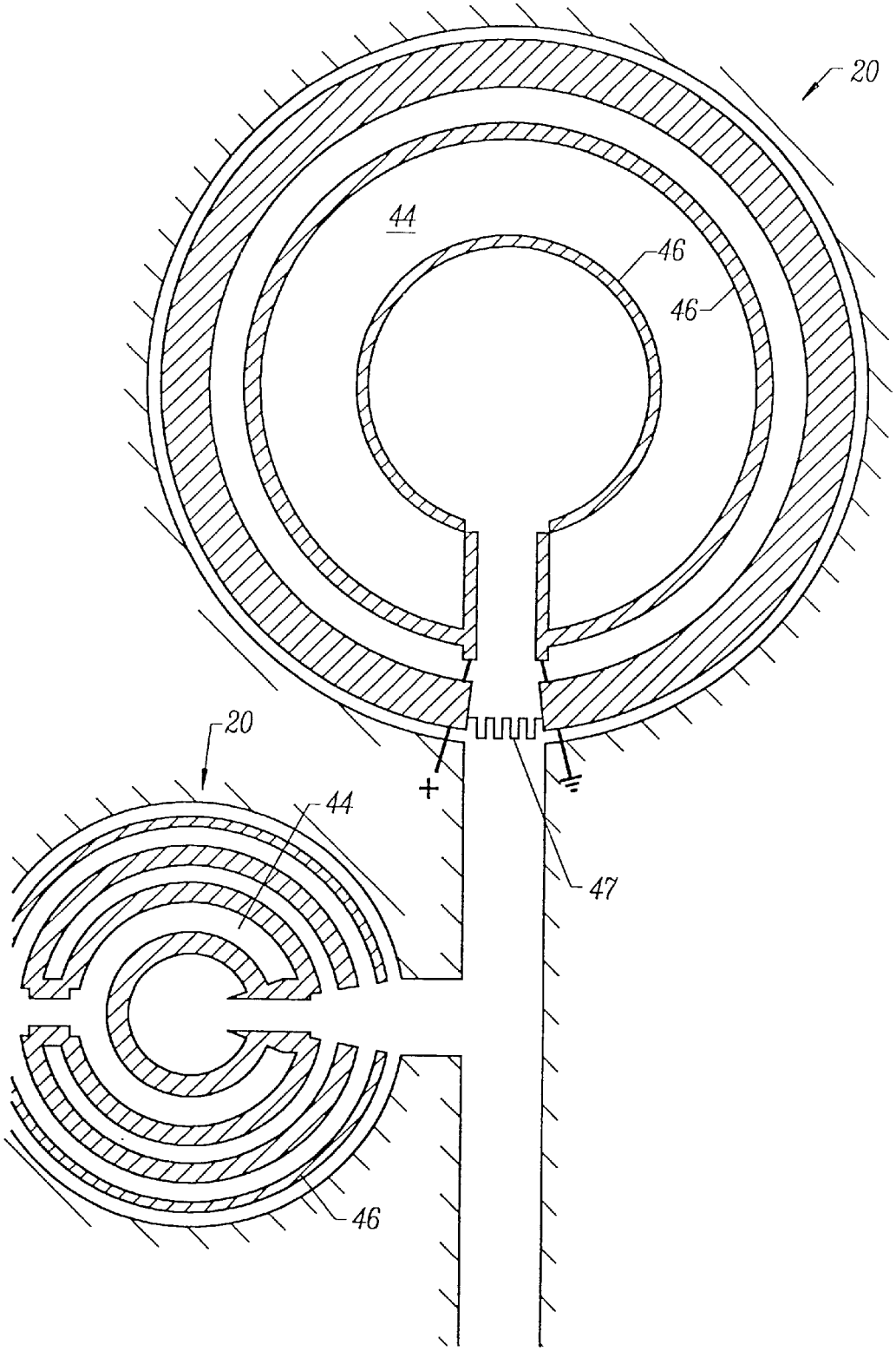
FIG. 6 illustrates a set of bubble-controlled pumps constructed in accordance with an embodiment of the invention.

FIG. 6 illustrates bubble-controlled pumps 20 in accordance with an embodiment of the invention. These pumps serve to alternately ingest and then expel fluid, thereby creating a pumping action. Each pump 20 consists of central chamber 44, and a set of heating elements 46. Fluid is expelled from the chamber 44 by activation of the heating elements 46, thereby forming a bubble which displaces fluid out of the chamber. In other words, the bubble-controlled pumps 20 operate by thermally evaporating a small amount of fluid at the end of a dead-end passage. The evaporating fluid displaces the remaining unevaporated fluid from the passage.

Observe in FIG. 6 that there is a heater 47 at the exit of the chamber 44. The heater 47 is operated such that it initially creates a bubble at this location. The geometry of the channel and chamber at this location forms a bubble-shaping structure such that the bubble does not move down the channel, but instead moves into the chamber 44. Thus, the bubble interface remains in proximity to the heater 47. The advantage of this technique is that it allows heat to be delivered directly to the point of evaporation, rather than to the vapor or substrate, thereby decreasing energy consumption and heat loss.

Figure 7:
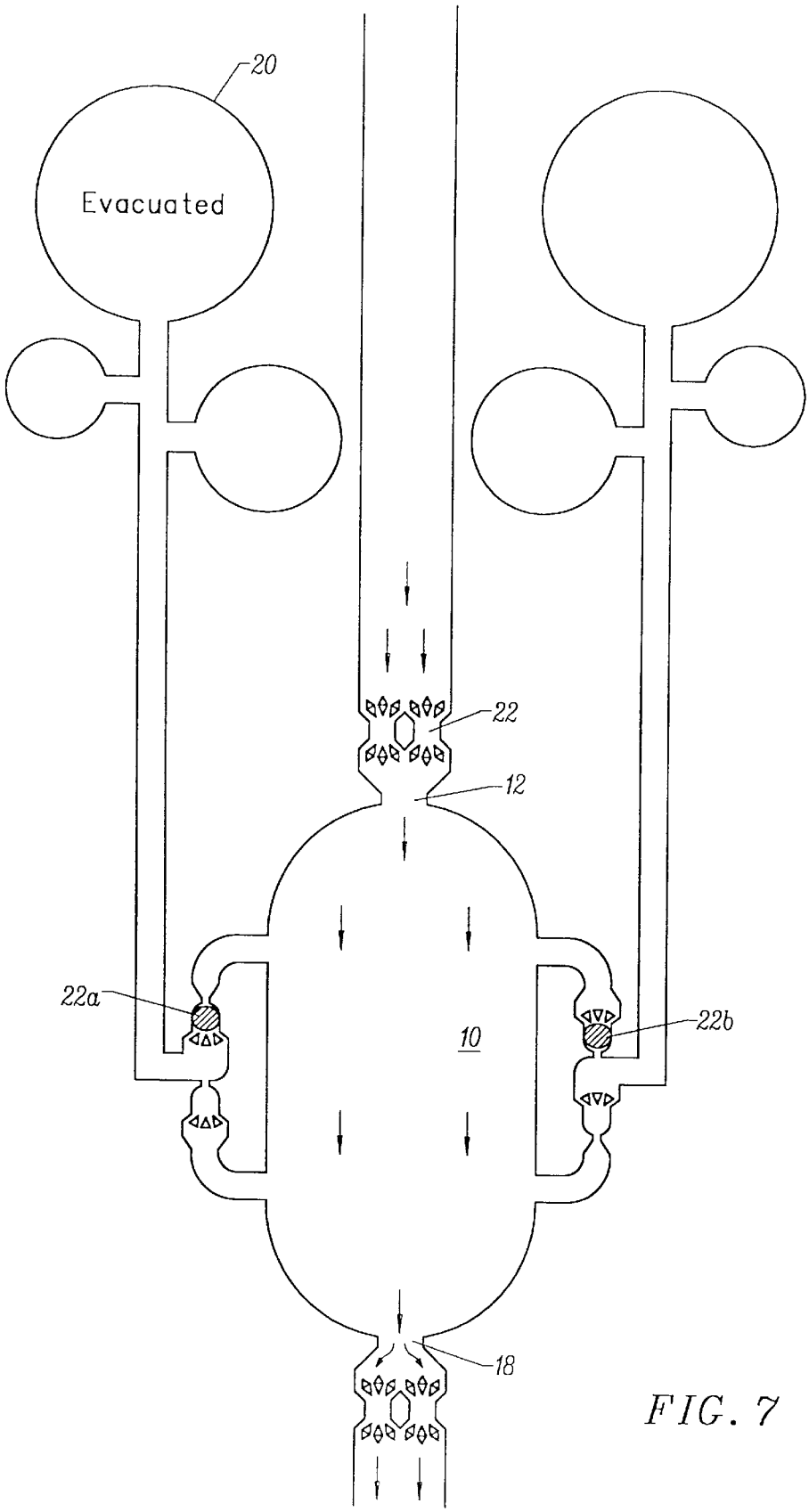
FIGS. 7–11 illustrate various valve configurations to effectuate the mixing of two liquids in accordance with an embodiment of the invention.
Figure 8:
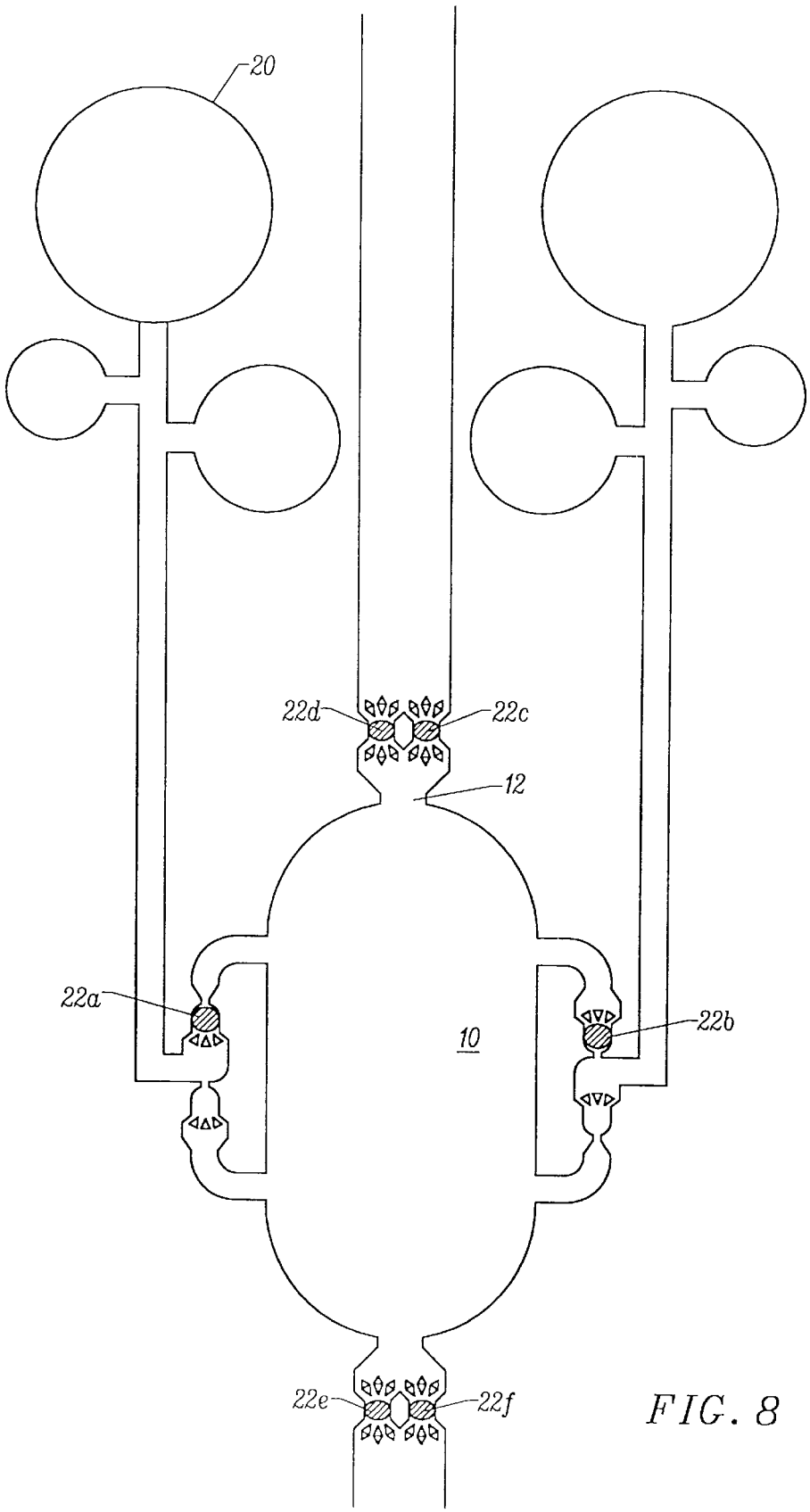

FIG. 7 illustrates initial processing steps performed during a liquid mixing operation in accordance with the invention. The former contents of the mixing chamber 10 are expelled through the unloading port 18. Thereafter, valves 22*e* and 22*f* are activated (turned-on), as shown in FIG. 8. Then, the fluid or fluids to be mixed are sequentially loaded through the loading port 12. Afterwards, valves 22*d* and 22*c* are activated (turned-on) to seal the mixing chamber 10. Bubble-controlled pump 20 remains evacuated (on), and valves 22*a* and 22*b* remain closed (on).

Figure 9:
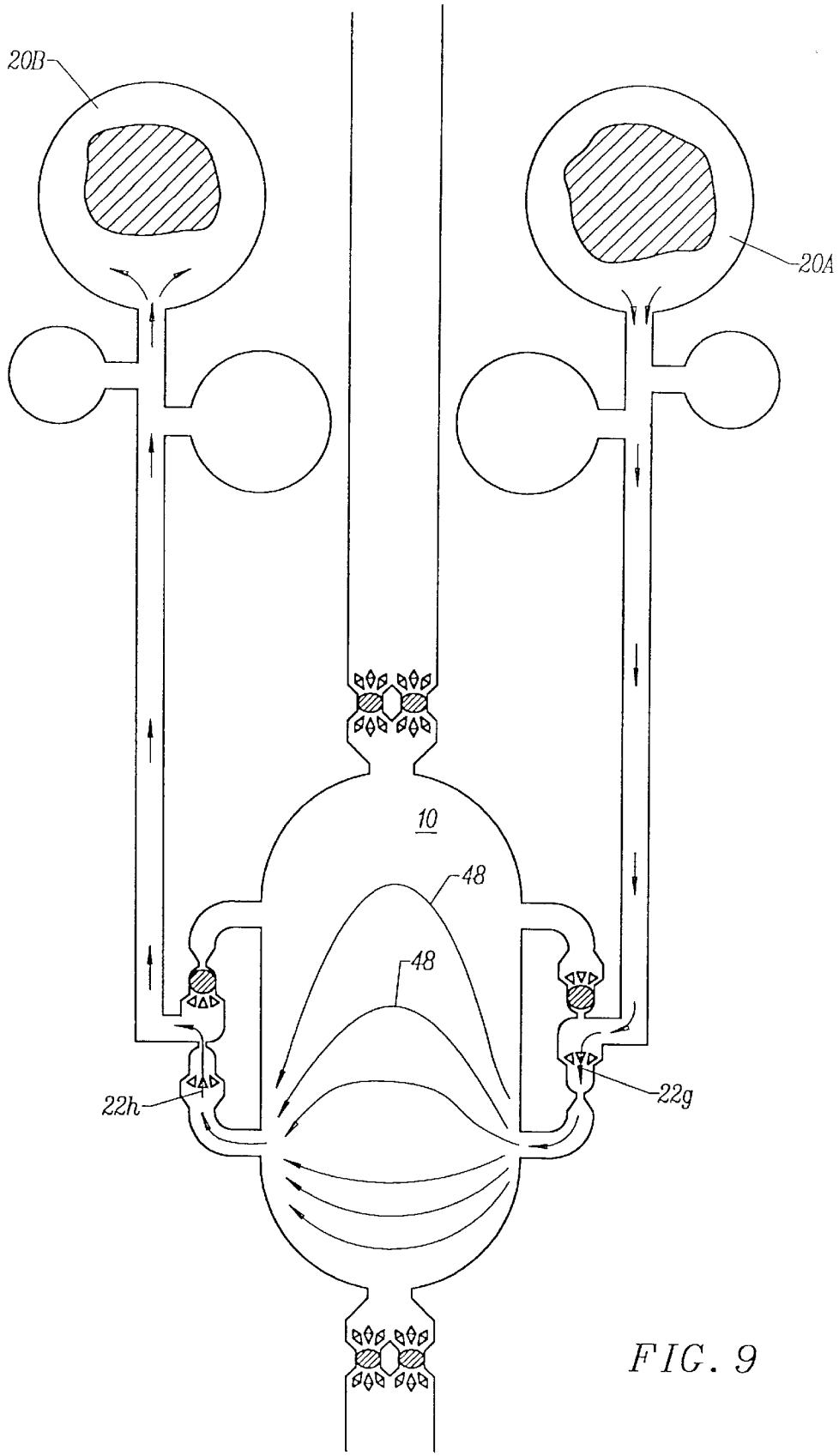

In FIG. 9, pump 20B is turned-off and is thereby filled with fluid from the mixing chamber 10. Simultaneously, pump 20A is turned-on and thereby evacuates the fluid within it. This causes open valves 22*g* and 22*h* to generate the flow field as shown with arrows 48.

Figure 10:
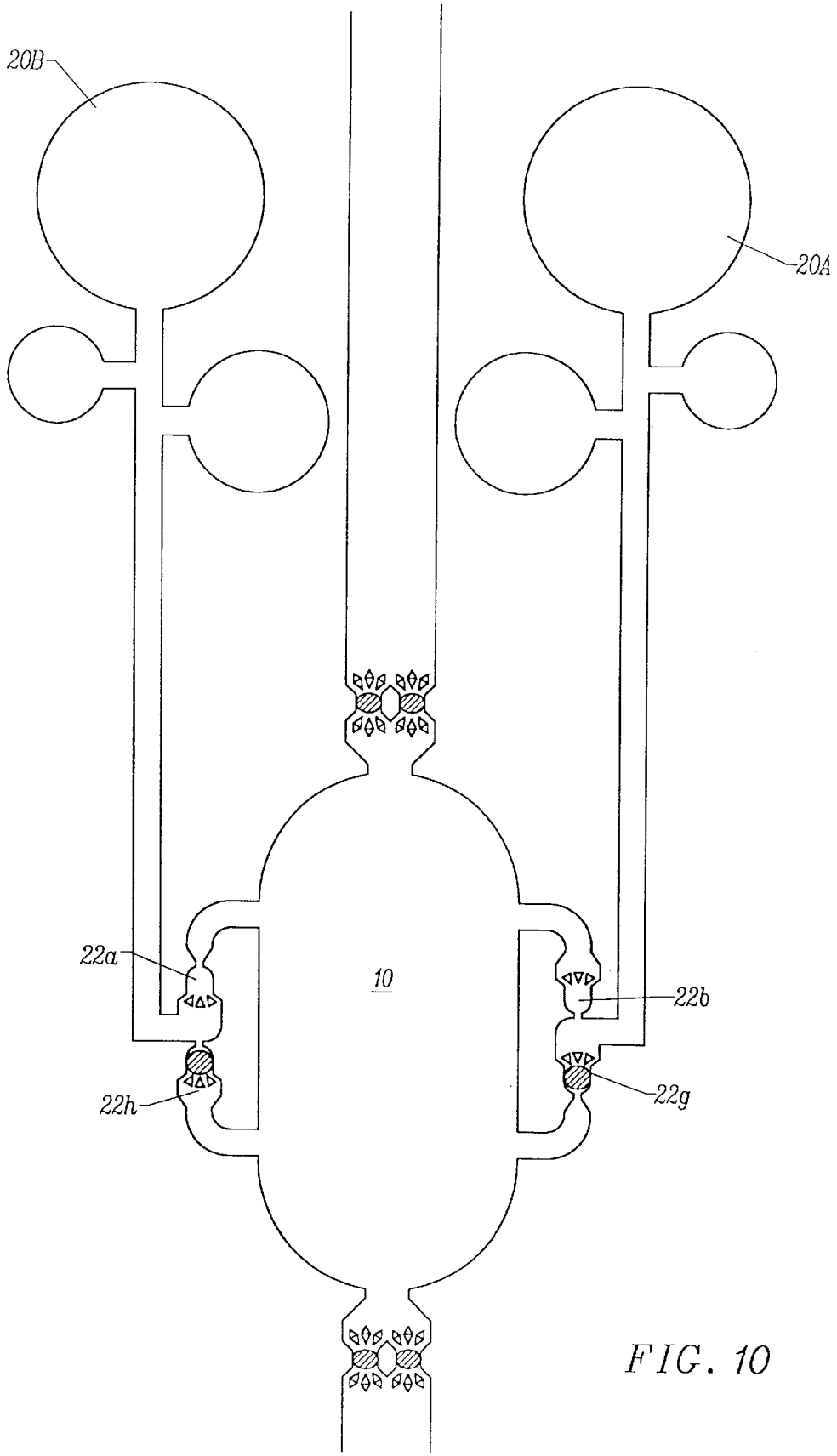
Figure 11:
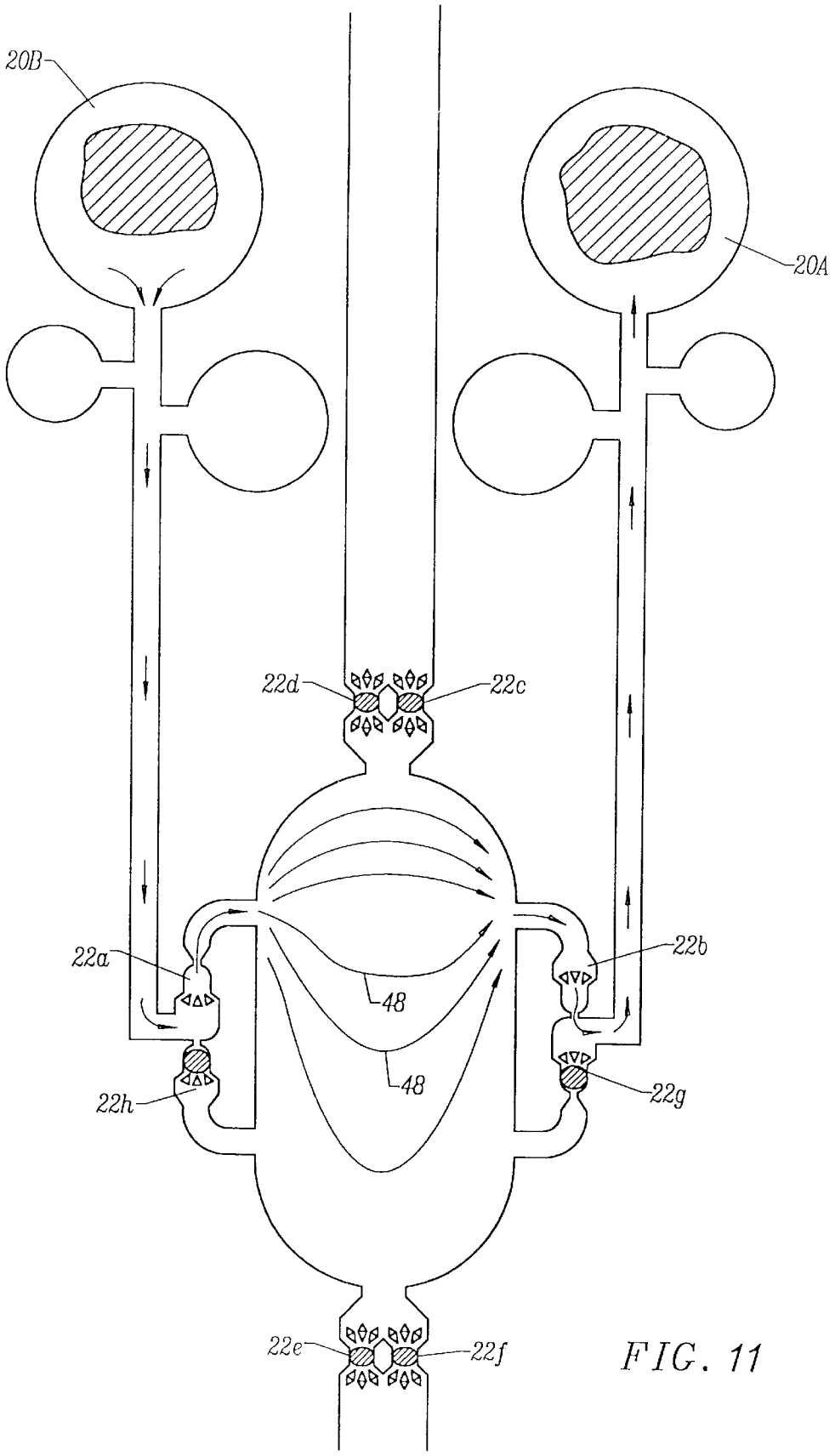

FIG. 10 illustrates that valves 22*a* and 22*b* are subsequently opened (turned-off) and valves 22*g* and 22*h* are closed (turned-on). Next, pump 20A is turned-off and is thereby filled with fluid, as shown in FIG. 11, while pump 20*b* is turned-on and thereby evacuates its fluid. This generates the flow field as shown with arrows 48.

The configuration of FIG. 9 is then employed. Thereafter, the configurations of FIGS. 10–11 are used until the desired level of mixing is achieved. Subsequently, the mixed products are pumped out of the chamber, as previously described in relation to FIG. 7.

The processing described in reference to FIGS. 7–11 is exemplary. Those skilled in the art will appreciate that there are numerous pump and valve sequences that may be exploited to achieve any number of desirable mixing profiles.

Observe that each pump 20 has an associated channel that is relatively long. As a result, a working fluid in the pump may never actually be expelled into the mixing chamber 10. Thus, the interactions between the fluid being mixed and the working fluid in the pump 20 may be minimized. The advantage of this embodiment is that the fluid being mixed need not be subject to a possibly destructive bubble process.

Figure 12:
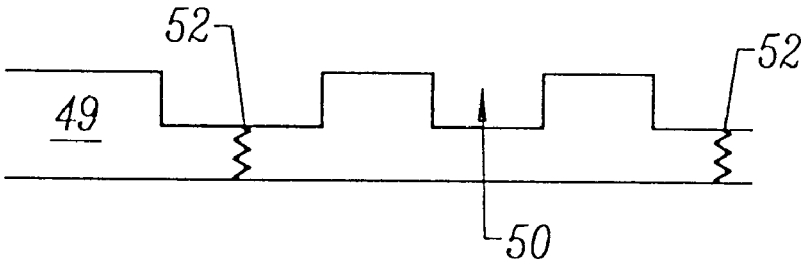
FIGS. 12–15 illustrate various processing steps during the fabrication of a device in accordance with an embodiment of the invention.
Figure 13:
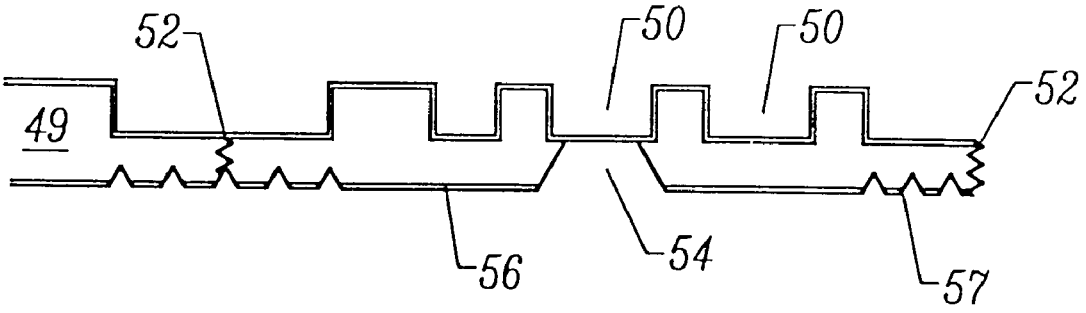

The device is fabricated using semiconductor microfabrication techniques. Fabrication begins with two wafers: an N-type double polished premium silicon wafer and a transparent quartz wafer. Processing on the silicon wafer proceeds as follows. The pattern for the disclosed structure is applied to the wafer using standard lithographic techniques. Patterns are also applied for contact release zones. These zones are subsequently used to provide access to electrical contacts. The wafer then undergoes a 10–100 $\mu$m high-aspect ratio silicon etch, thereby generating the flow passages 50, and contact release zones 52 in wafer 49, as shown in FIG. 12. A blanket 0.5 $\mu$m nitride deposition is performed, and the nitride is then patterned and etched on the back side of the wafer to define etch holes through the wafer, and cutting alignment marks. A KOH etch is then performed, thereby etching holes through the wafer that will be used to bring fluid into and out of the device. FIG. 13 illustrates the etch holes 54, nitride layer 56, and etch marks 57. The nitride layer 56 is then removed, completing processing of the silicon wafer.

A clear quartz wafer may be used as a top for the flow passages to allow visual observation. Processing of this wafer proceeds as follows: a polysilicon deposition is performed, and then the polysilicon layer is patterned and etched, creating the heaters needed to generate bubbles. These heaters are connected to each other, and linked to the edge of the die, with aluminum traces, which are deposited, patterned, and etched. A low temperature oxide layer is then applied to isolate the electrical components and etch holes are opened up to the aluminum bonding pads.

Figure 14:
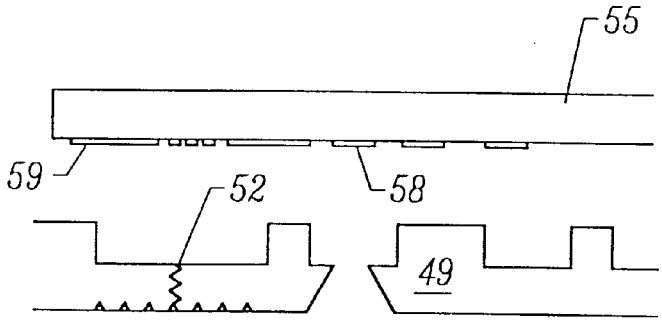
Figure 15:
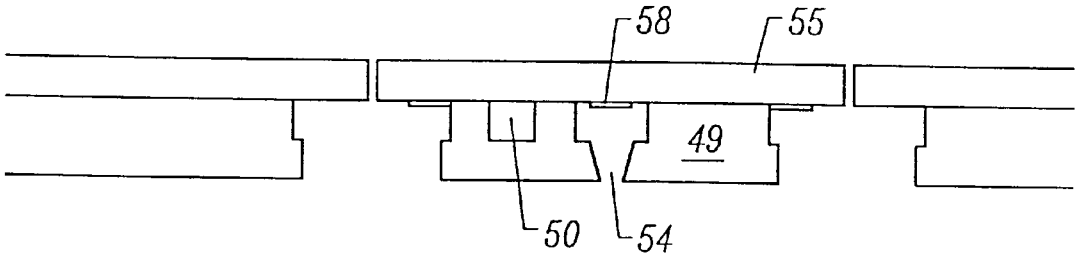

The quartz wafer 55, with polysilicon heaters 58 and aluminum traces 59, is then aligned with the silicon wafer 49, as shown in FIG. 14. The two wafers are then pressed together and bonded. The wafers are then cut into dies with a series of cuts. First, the silicon wafer is cut in two locations between each die. This releases a strip of silicon which can be removed, exposing the aluminum electrical bonding pads. The quartz wafer is then cut between each die. The resulting device appears as in FIG. 15.

A different and more detailed description for the process flow for constructing an apparatus in accordance with the invention is described in connection with FIGS. 16–30. Double-sided polished prime wafers are preferably used. The wafers are preferably scribed with identifying information. Scratch alignment marks are then applied to the wafers. The alignment marks are applied exactly opposite each other on the two sides of the wafers, such that features aligned to marks on one side of the wafer will be aligned, through the wafer, to features aligned to the marks on the other side.

Initially, wafers are cleaned using standard cleaning steps. For example, the following steps may be used: a 10 minute Piranha bath (Sulfuric Acid with Hydrogen Peroxide) at 120° C.; a de-ionized water rinse including three rinses of a minute each; a 5:1 CMOS Grade Buffered Oxide Etch until the wafer is hydrophobic; a de-ionized water rinse, including two rinses of a minute each, and a third rinse until resistivity reaches 10.7 MΩ-cm; and a spin dry, in nitrogen, at 2400 RPMs for one minute.

The wafers are then dehydrated, for example, in an oven for twenty minutes at 120° C. Hexamethyldisilazane (HMDS) is then vapor deposited using an HMDS bubbler for five minutes. That is, nitrogen gas is passed through the HMDS to produce a saturated vapor to which the wafer is exposed for five minutes.

Photoresist is then applied. For example, four applications of positive resist (e.g., OCG825 G-line positive resist) is applied to the backside of the wafer. Each application may consist of a 30 second spin at 2.2K RPMs followed by a 60 second soft bake on a hot plate at 90° C. The resultant nominal photoresist thickness is 8 $\mu$m after four applications.

The wafer is then exposed with the desired pattern for the fluid interconnects. For example, the back side of the wafer is exposed at approximately 540 mJ/cm$^2$. The pattern is aligned to the previously described scratch marks.

The wafer is then developed using standard techniques. (For example, OCG-934:2-1 may be deposited in a puddle on the wafer for 30 seconds, after which the wafer is rinsed and spun dry at 3.5K RPMs for 15 seconds. This process is repeated four times.) The wafer is then hard baked at 120° C. for approximately 45 minutes.

Figure 16:
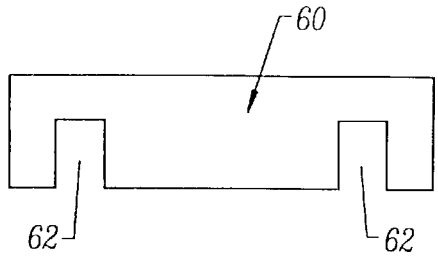
FIGS. 16–30 illustrates various processing steps during the fabrication of a device in accordance with an embodiment of the invention.

The backside of the wafer is then subjected to an anisotropic silicon etch. For example, a 25:1 ratio may be used to achieve a 400 μm etch. This operation has been performed with a Surface Technology Systems, Inc. etcher. The resultant device is shown in FIG. 16. In particular, the figure shows a wafer 60 with etch apertures 62.

The photoresist is then stripped. (For example, a the wafer may be soaked in PRS 2000 for 20 minutes at 90° C.) Afterwards, three de-ionized water rinses of a minute each may be performed. The wafer is then spun dry for 1 minute at 2400 RPMs.

Figure 17:
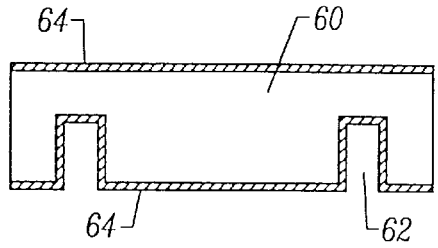
Figure 18:
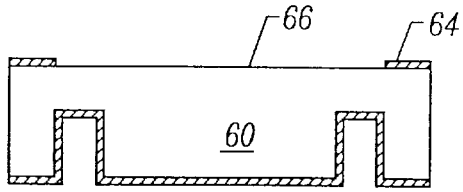

A wet thermal oxidation operation may then be performed. This operation may include a standard wafer cleaning operation of the type described above. A standard "super clean" operation is then performed. For example, the following steps may be used: a 10 minute Piranha bath at 120° C.; a de-ionized water rinse including three rinses of a minute each; apply a 10:1 VLSI Grade Hydrofluoric Acid until the wafer is hydrophobic; a de-ionized water rinse, including two rinses of a minute each, and a third rinse until resistivity reaches 13.2 MΩ-cm; and spin dry at 2400 RPMs for one minute. A wet oxidation step is then performed at 1100° C. for 180 minutes. This results in a nominal oxide thickness of 1.2 μm. A nitrogen anneal is then performed for 20 minutes at 1100° C. The resultant thermal oxide 64 is illustrated in FIG. 17.

The subsequent processing steps relate to flow channel lithography. This entails an initial dehydration step. HMDS is then applied using an HMDS bubbler for 5 minutes. Positive photoresist is then applied to the front side, for example, using a 30 second spin at 5K RPMs followed by a sixty second soft bake on a hot plate at 90° C. This results in a nominal photoresist thickness of 1.3 μm. The photoresist is then exposed and developed. The wafer may then be hardbaked for 45 minutes at 120° C.

An oxide etch is then performed. For example, a Lam Research oxide etch (850 Watts, 0.38 gap distances, 120 sccm Helium, 30 sccm $CHF_3$, 90 sccm $CF_4$) may be used. The photoresist is then stripped, to produce the device of FIG. 18, which includes an oxide aperture 66.

An interconnect pattern is then established in the oxide aperture 66. This operation begins with a dehydration step, for example, dehydrating the wafer for 20 minutes at 120° C. HMDS is then applied using an HMDS bubbler for five minutes. Photoresist is then applied. For example, two applications of 0CG825 positive resist may be applied to the front side of the wafer. Each application may consist of a 30 second spin at 2.2K RPMs, followed by a 60 second soft bake on a hot plate at 90° C. The nominal photoresist thickness is 4 μm after two applications.

Figure 19:
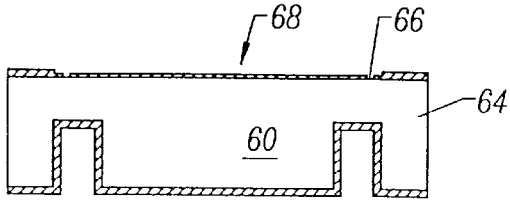

The pattern on the front side of the wafer is then exposed. For example, the wafer may be exposed at 360 mJ/cm$^2$. The wafer is then developed using a technique of the type described above. The wafer is then hardbaked for forty-five minutes at 120° C. FIG. 19 illustrates the resultant photoresist pattern 68.

Figure 20:
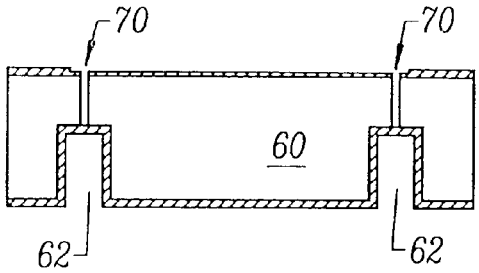

A two-level etch is then performed. For example, the interconnects from the front side can be etched using photoresist mask. A standard 25:1 anisotropic silicon etch recipe can be used to produce a 150 μm etch. The resultant interconnect etch 70 is shown in FIG. 20.

The photoresist is then stripped. For example, the wafer may be soaked in PRS 2000 for 20 minutes at 90° C. Three de-ionized water rinses of a minute each may then be performed. The wafer is then spun dry at 2400 RPMs for 1 minute.

Figure 21:
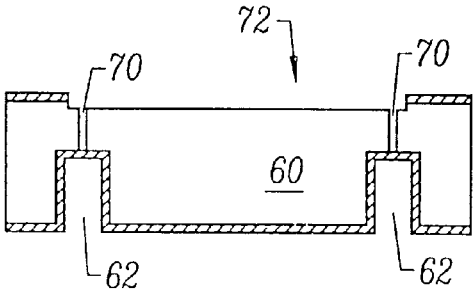

A channel etch is then performed. That is, a flow channel is etched from the front side using the oxide mask. For example, a standard 25:1 anisotropic silicon etch recipe may be used to achieve a 10 μm etch. The resultant flow channel 72 is illustrated in FIG. 21. At this point, the fluidic channel fabrication is completed.

The coverplate with heaters is then fabricated. Processing begins with a quartz wafer. A doped polysilicon LPCVD operation is then performed. This operation begins with a standard cleaning procedure, which may include the following steps: a 10 minute Piranha bath (Sulfuric Acid with Hydrogen Peroxide) at 120° C.; a de-ionized water rinse, including two rinses of a minute each, and a third rinse until resistivity reaches 10.7 MΩ-cm; and spin dry at 2400 RPMs for one minute.

A subsequent super-clean operation is then performed. This operation may include the following steps: a 10 minute Piranha bath at 120° C.; a de-ionized water rinse including two rinses of a minute each, and a third rinse de-ionized water rinse until resistivity reaches 13.2 MΩ-cm; and spin dry at 2400 RPMs for one minute.

Figure 22:
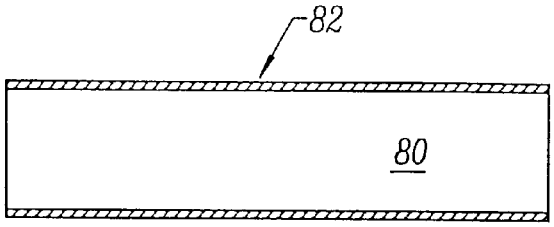

The doped polysilicon low pressure chemical vapor deposition step is then performed. In particular, 25 Ohms/square layer is deposited at a temperature of 610° C., 100 slpm $SiH_4$, 0.25 slpm $Ph_3$, approximately 90 minutes for approximately 3000 Å layer. A nitrogen anneal for 30 minutes at 950° C. is then performed. The resultant quartz substrate 80 with a doped polysilicon layer 82 is illustrated in FIG. 22.

Lithography processing for the heaters is then performed. The quartz wafer is dehydrated for 20 minutes at 120° C. HMDS is then applied in an HMDS bubbler for 5 minutes. Positive resist (e.g., OCG825 positive resist) is then applied on the front side of the wafer. A 30 second spin at 5K RPMs is followed by a 60 second soft bake on a hot plate at 90° C. The nominal photoresist thickness at this point is 1.3 μm.

The quartz wafer is then exposed through an approximately 180 mJ/cm$^2$ exposure. The photoresist is then developed (for example, in OCG 934:2-1). A two puddle develop of 30 seconds each may be used. The quartz wafer is then rinsed and spun dry. Thereafter, a hard bake operation for 45 minutes at 120° C. is performed.

Figure 23:
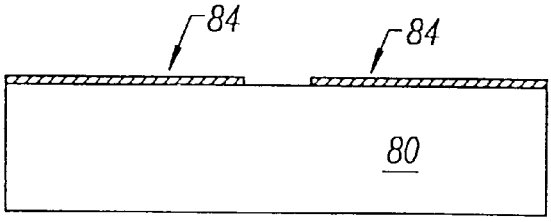

A wet silicon etch is then performed to form the heaters. For example, an etch in Silicon Etchant (64% $HNO_3$, 33% $H_2O$, 3% $NH_4F$) may be used. The quartz wafer is then rinsed and spun dry, for example, using the following steps: two de-ionized water rinses of one minute each, a subsequent de-ionized water rinse until the resistivity reaches 10.7 MΩ-cm, and a two minute spin dray at 2400 RPMs. The resultant polysilicon heaters 84 are illustrated in FIG. 23.

Figure 24:
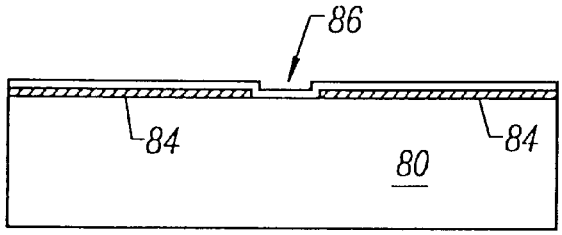

An aluminum deposition operation is then performed. This operation includes cleaning the quartz wafer with a HF dip, for example, including the following steps: a short (e.g., 10 second) dip in 10:1 VLSI Grade Hydrofluroic Acid, two de-ionized water rinses of one minute each, and a third de-ionized water rinse until the resistivity reaches 10.7 MΩ-cm, and a one minute spin dry in Nitrogen at 2400 RPMs. Immediately thereafter, 1 μm Aluminum/2% Silicon is sputtered onto the wafer. The resultant aluminum layer 86 is illustrated in FIG. 24.

An aluminum lithograph operation is then performed. This operation begins by dehydrating the quartz wafer for 20 minutes at 120° C. HMDS is then applied using a HMDS bubbler for five minutes. Photoresist is then applied. For example, CG825 positive resist on the front side of the wafer may be applied. A 30 second spin at 5K RPMs is then followed by 60 second soft bake on a hot plate at 90° C. A nominal photoresist thickness of 1.3 $\mu$m results. The photoresist is then subjected to a 180 mJ/cm$^2$ exposure. The photoresist is then developed, for example using OCG934:2-1. A two puddle develop of 30 seconds each may be used. The wafer is then rinsed. It is then spun dry at 3.5K RPMs for 15 seconds. The wafer is then baked at 120° C. for 45 minutes.

Figure 25:
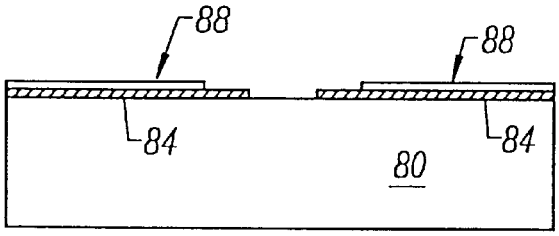

The aluminum is then etched to form leads. This operation may be performed with a wet aluminum etch. For example, an etch in aluminum etchant (e.g., CleanRoom® Electronic Chemicals Aluminum Etch I with Surfactant, 87% Phosphoric Acid, 11% Acetic Acid, 2% Nitric Acid by volume) may be used until the field is clear. The wafer is then rinsed and spun dry, for example, with the following steps: two de-ionized water rinses of one minute each, a de-ionized water rinse until the resistivity reaches 10.7 MΩ-cm, and a two minute spin dry at 2400 RPMs. The resultant aluminum leads 88 are illustrated in FIG. 25.

Figure 26:
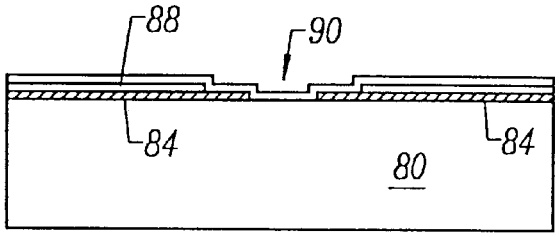

A low temperature oxide is then applied to the wafer. The oxide deposition is preceded by a rinse operation, for example, including the following steps: two de-ionized water rinses of one minute each, a de-ionized water rinse until the resistivity reaches 13.2 MΩ-cm, and a two minute spin dry at 2400 RPMs. A low-temperature LPCVD Oxide, 5000 Å, 400° C., 90 sccm $O_2$, 60 sccm $SiH_4$, 300 mTorr process pressure may be used. The resultant low temperature oxide film 90 is shown in FIG. 26.

Bonding pad lithography is then performed. This operation includes dehydrating the wafer for twenty minutes at 120° C. HMDS is then applied using an HMDS bubbler for five minutes. Photoresist is then applied. For example, OCG825 positive resist may be applied to the front side of the wafer. A 30 second spin at 5K RPMs is then followed by a sixty second soft bake on a hot plate at 90° C. This results in a photoresist thickness of 1.3 $\mu$m. A 180 mJ/cm$^2$ exposure is then performed. The device is then developed in OCG 934:2-1. A two puddle develop of 30 seconds each is used. The device is then rinsed and spun dry at 3.5K RPMs for fifteen seconds. The device is then hard baked for 45 minutes at 120° C.

Figure 27:
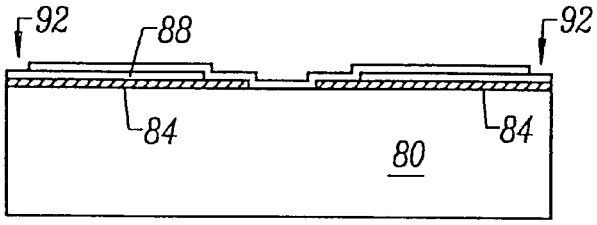

A bonding pad oxide etch step is then performed. A Lam Research oxide etch of 850 Watts, 0.38 gap distance, 120 sccm Helium, 30 sccm $CHF_3$, 90 sccm $CF_4$ may be used. The photoresist is then stripped by soaking the wafer in PRS 2000 for 20 minutes at 90° C. The wafer is then rinsed three times with de-ionized water for one minute each rinse. The wafer is then spun dry for one minute at 2400 RPMs. The resulting bonding pads 92 are shown in FIG. 27. This completes the fabrication of the coverplate.

Figure 28:
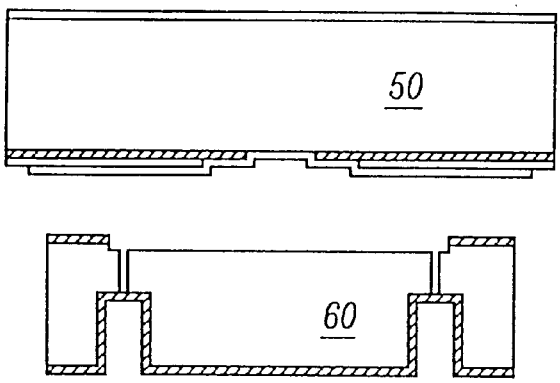

The device is then assembled. This operation begins by dicing the silicon and quartz wafers. Photoresist is applied during this operation. For example, OCG825 positive resist may be applied to the front side of the wafer. The wafer is then spun for 30 seconds at 5K RPMs. This is followed by a sixty second soft bake on a hot plate at 90° C. The nominal photoresist thickness is 1.3 $\mu$m at this point. Dicing tape is then applied to the back side of the wafer. The wafers are diced with a dicing saw. The silicon wafers are cut smaller than the quartz wafers to leave bonding pads exposed when assembled. The dice tape is then removed. The device is then rinsed with Acetone, followed by Alcohol, followed by de-ionized water. An individual silicon wafer 60 and corresponding quartz wafer 80 is illustrated in FIG. 28.

Figure 29:
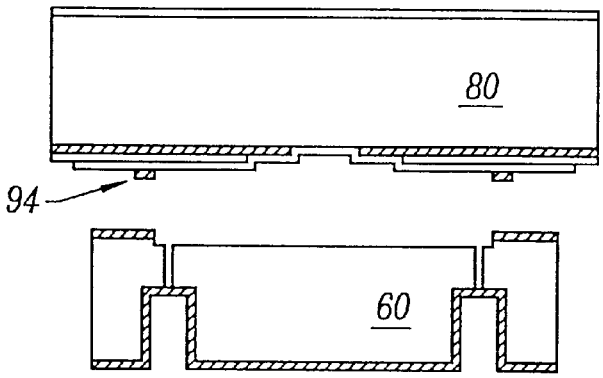

Lithography to form a gasket ring is then performed. This entails dehydrating the dice for twenty minutes at 120° C. HMDS is then applied using an HMDS bubbler for five minutes. Photoresist is then applied, for example, by spin coating OCG 838581 SC Negative Photo Resist, at 10K RPMs for forty-five seconds. The dice are then soft baked for sixty seconds on a hot plate at 90° C. The quartz die is then exposed at 40 mJ/cm$^2$. The die is then developed, for example, with OCG WNRD Negative Resist Developer (isoparaffinic hydrocarbon) for twelve minutes. An OCG Rinse I Negative Resist Rinse (Butyl Acetate) may then be used for 30 seconds. The resultant gasket 94 is illustrated in FIG. 29.

Figure 30:
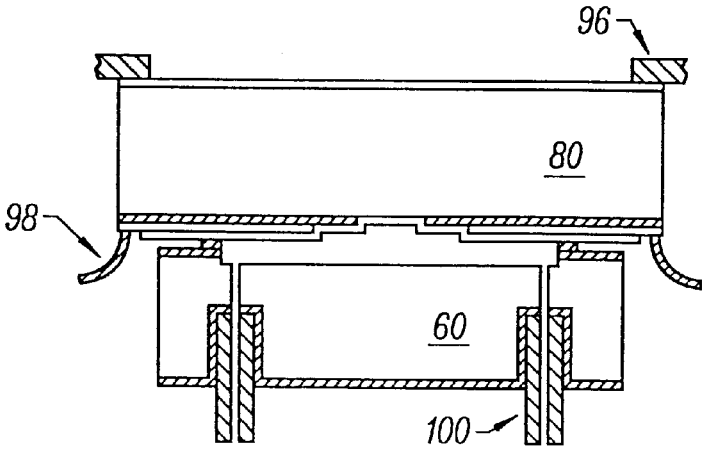

The device is then assembled. The silicon and quartz dice are aligned and pressed together. They are then hard baked for 24 hours at 120° C. to remove photoresist solvents. The part is then attached to a package with an epoxy adhesive, for example JB Bond epoxy adhesive. Wirebonds are connected from the bond pads to the package. The wirebonds are then encapsulated with a rapidly curing epoxy. Fluid interconnections are then established by breaking the oxide membranes and inserting polyimid tubing into the fluidic interconnects. The tubing is fixed in place with epoxy adhesive. The resultant device is illustrated in FIG. 30. In particular, FIG. 30 illustrates the silicon wafer 60, the quartz wafer 80, a portion of the package 96, wirebonds 98, and tubing 100.

The invention has now been fully described. Attention presently turns to a discussion of different attributes of the invention. The device of the invention achieves mixing via planar laminar flow. As previously indicated, a MEMS device is effectively a planar device. The disclosed operation of the bubble-controlled pumps 20 and bubble-controlled valves 22 results in laminar flow within the mixing chamber 10, which is essentially planar. A laminar flow is one in which velocity, pressure, and other flow parameters do not vary irregularly with time. A planar laminar flow is one in which the flow field is uniform (e.g., parabolic) throughout the planar device and in which velocity, pressure, and other flow parameters do not vary irregularly (or are uniform) over time.

The device of the present invention can also be viewed as employing chaotic advection to mix fluids in a planar, laminar environment. A chaotic flow field is one in which the path and final position of particles placed within the field are highly sensitive to their initial position. In a chaotic flow field, particles initially close together may become widely separated, and the flow as a whole becomes well mixed. Chaotic advection is the process of mixing with flow fields that are regular in space and time, yet which cause particles initially close together, to become widely separated, and the flow as a whole to become well mixed.

The prior art demonstrates that planar flow consisting of blinking (pulsing) spatially separated sources and sinks results in a chaotic system. A particle in such a flow moves alternately away from the source, and then towards the sink with fluid ingested by the sink being expelled by the source.

In an enclosed, finite device containing an incompressible fluid, sources and sinks must occur in pairs to satisfy volume conservation. A system containing two sources and two sinks arranged anti-symmetrically create quadrapole flow when sources and sinks are operated continuously. A chaotic flow field may be generated by varying the strength or position of the sources and sinks in time. The anti-symmetric first-in-last-out pulsed dipole mixer is arguably the simplest configuration. As described in relation to FIG. 3, the central "pill shaped" mixing chamber 10 is flanked by four channels. The upper-left port **16*d* and the lower-right port 16*b* are sources (inputs), while the lower-left port 16*c* and upperright port 16***a* are sinks (outputs). Fluids to be mixed are loaded into the mixing chamber 10, and pumps 20 and valves 22 are activated so as to move fluid repeatedly left-to-right across the top (upper dipole), then right-to-left across the bottom (lower dipole), with plugs of fluid extracted by a sink being inverted before reinsertion by a source (first-in-last-out). This implementation utilizes thermally created vapor bubbles for both pumping and valves, with heat supplied by polysilicon heaters and aluminum traces.

The pulsed dipole mixer is characterized by a source/sink separation distance for each dipole, 60*a;* a dipole/dipole separation distance, 60*b* (shown in FIG. 3); and a source/sink strength. As is common in fluid mechanics, the source/sink strength is specified by Q (area per second), such that the volume (expressed as an area) that each source and sink pumps into an infinite plane in each stroke is Qt, where t is the length of time that each source/sink operates. In the disclosed device, each source/sink expels fluid into a half-plane, and thus the pump size is decreased to V=(Qt)/2. The pump size can also be characterized by a length scale λ, where $$\lambda = \sqrt{Q/\pi} = \sqrt{(2V)/\pi}\,.$$

Ignoring viscosity, diffusion, and the height of the device, there are three length scales (a, b, and λ), which define a two parameter system: B=b/a, the aspect ratio of the mixer, and Λ=λ/a, the relative pump size. Extreme values of these parameters yield devices which, in general, produce little mixing. For example, for large aspect ratios, B, the two dipoles will be widely separated and will operate independently, creating a net clockwise flow, but little mixing. For small aspect ratios, the upper and lower dipoles will be nearly on top of each other, and will simply undo each other's work. Similarly, for small pump sizes, Λ, the time dependence is effectively lost and the flow will approach a steady quadrapole flow. Finally, for large pump sizes, Λ, the ratio of fluid in the pump to that in the mixer will become large, and the effect of the mixer itself will be negligible. Though plug inversion caused by the first-in-last-out pumps creates additional complications, analysis of limit cases suggests that optimal mixing will occur for over a range of moderate pump sizes and aspect ratios.

The five mixing chambers 20 of FIG. 2 have aspect ratios, B, ranging from 1 to 3.5. Each is fitted with three pumps 10 on each side, with radii $\lambda/(\sqrt{2})$=106 μm, 159 μm, and 254 μm, which can be operated alone orjointly in up to seven different permutations, yielding seven effective pump sizes for each chamber. Thus, the device incorporates 35 effective permutations of aspect ratios and pump sizes.

As discussed above, bubble-controlled valves (or thermocapillary bubble valves) operate by creating a vapor bubble within specially designed chambers and then use the bubble to prevent flow through the chamber. A bubble can support a pressure differential if the radii of curvature, r, of its front and rear surfaces differ. The magnitude of this pressure differential is $\Delta P=\sigma(1/r_1-1/r_2)$, where σ is the surface tension (around 0.6 atm-μm for water). By splitting the front interface into a set of parallel converging passages, and using a single parallel, or circularly converging, rear passage, the difference between the two radii can be increased. (Note that for chambers with a constant height, only the in-plane radii are significant.)

The diamond shaped columns 41 shown in the figures have been implemented as 13 μm wide and 100 μm tall structures that form a cage which constrains bubble movement. The valve is designed to withstand a pressure differential on the order of 0.05 atm, about an order of magnitude larger than required for a 0.5 Hz mixing cycle frequency. Smaller chamber heights, on the order of ½ the valve chamber width, facilitate bubble formation and valve sealing.

The invention can be considered to utilize two important strategies in achieving its mixing function. First, a laminar time-dependent, planar, chaotic flow field is employed to effect mixing within the mixing chamber. In the preferred embodiment, this flow field takes the form of a perturbed quadrapole flow, or more specifically, a "pulsed double-dipole" flow field. This allows mixing to occur in spite of the planar laminar nature of the flow. Another important strategy utilized by the invention is that the fluid is manipulated and mixing is effected through the use of bubbles and/or droplets. In the preferred embodiment, these bubbles are thermally generated, although they could be formed through electrochemical or other processes. The use of bubbles negates the need for moving parts, while still allowing for the manipulation and control of the fluid need for mixing.

Those skilled in the art will appreciate that there are many alternate embodiments of the disclosed technology that will fall within the scope of the invention. For example, an otherwise planar device may be modified to include trenches or some other type of three-dimensional structure. Such modifications would still be within the scope of the planar structure of the invention if they are not significant in the mixing operation. In other words, the structure will be in accordance with the invention if it still predominantly operates by planar laminar flow.

Those skilled in the art will also appreciate that the planar laminar mixing of the invention may be achieved through a variety of techniques. That is, embodiments of the invention may not include bubble-controlled valves and pumps. Alternate mechanisms for moving and controlling fluids may be used. For example, alternate valve and pump configurations may be used to achieve planar laminar flow.

Those skilled in the art will also appreciate that a variety of bubble-controlled devices may be used. As previously discussed, bubbles may be formed through evaporation of a liquid. Alternately, bubbles may be formed through sublimation of a solid. For example, using dry ice of a solid that sublimates when subjected to a charge. Alternately, bubbles may be formed electrochemically. For example, through electrolysis of water. Chemical reactions may also be used to form bubbles. For example, selected chemical reactions oscillate between liquid and gas phases may be used.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A microelectromechanical device configured to mix a fluid using predominantly planar laminar flow, wherein said microelectromechanical device includes a mixing chamber; and a plurality of bubble-controlled valves to establish said predominantly planar laminar flow in said mixing chamber.

2. The apparatus of claim 1 further comprising a plurality of bubble-controlled pumps operating with said plurality of bubble-controlled valves to establish said predominantly planar laminar flow in said mixing chamber.

3. The apparatus of claim 2 further comprising a channel between said mixing chamber and a selected bubble-controlled pump of said plurality of bubble-controlled pumps, said channel containing a working fluid, separate from said fluid of said mixing chamber, said working fluid being processed by said selected bubble-controlled pump so as to mix said fluid in said mixing chamber.

4. The apparatus of claim 3 further comprising a heater positioned between said selected bubble-controlled pump and said channel.

5. The apparatus of claim 2 wherein said plurality of bubble-controlled pumps and said plurality of bubble-controlled valves establish a pulsed double-dipole flow field in said mixing chamber.

6. The apparatus of claim 1 wherein a bubble-controlled valve of said plurality of bubble controlled valves includes a bubble-shaping structure to alter the radius of curvature of a bubble formed in said bubble-controlled valve to support a pressure differential across said bubble.

7. The apparatus of claim 6 wherein said bubble-shaping structure includes a set of converging passages.

8. The apparatus of claim 1 wherein said planar laminar flow includes chaotic advection.

9. The apparatus of claim 1 comprising a set of fluid exchange inlets and fluid exchange outlets operated in a time dependent manner to establish said predominantly planar laminar flow.

10. The apparatus of claim 9 comprising two fluid exchange inlets and two fluid exchange outlets operating in a time dependent fashion to achieve a perturbed quadrapole flow.

11. A microelectromechanical device configured to mix a fluid in a mixing chamber through the operation of bubble-controlled valves that selectively create and destroy bubbles and thereby control fluid flow in said mixing chamber.

12. The apparatus of claim 11 further comprising a heater to form bubbles through evaporation of a liquid.

13. A microelectromechanical device, comprising a dead-end passage formed in a substrate, said dead-end passage including a bubble forming mechanism to selectively cause fluid to be ingested and expelled from said dead-end passage and thereby cause fluid motion.

14. The apparatus of claim 13 wherein said bubble forming mechanism selectively causes the evaporation of a liquid.

15. A method of mixing a fluid, said method comprising the steps of:

isolating a fluid in a mixing chamber; and controlling the delivery of fluid into and out of said mixing chamber with bubbles and thereby perturbing said fluid in said mixing chamber to create planar laminar flow of said fluid in said mixing chamber.

16. The method of claim 15 wherein said controlling step includes the step of forming said bubbles through sublimation of a solid.

17. The method of claim 15 wherein said controlling step includes the step of forming said bubbles electrochemically.

18. The method of claim 15 wherein said controlling step includes the step of forming said bubbles by a chemical reaction.

19. The method of claim 15 wherein said controlling step includes the step of selectively controlling bubbles to produce chaotic advection of said fluid in said mixing chamber.

* * * * *